US011959694B2

(12) United States Patent
Conrad et al.

(10) Patent No.: US 11,959,694 B2
(45) Date of Patent: Apr. 16, 2024

(54) CRYOCOOLER HEALTH MONITORING SYSTEMS AND METHODS

(71) Applicant: Teledyne FLIR Commercial Systems, Inc., Goleta, CA (US)

(72) Inventors: Theodore Conrad, Goleta, CA (US); Samuel S. Chapple, Goleta, CA (US); Roberto Olivo, Goleta, CA (US); Jeff Haller, Goleta, CA (US)

(73) Assignee: Teledyne FLIR Commercial Systems, Inc., Goleta, CA (US)

( * ) Notice: Subject to any disclaimer, the term of this patent is extended or adjusted under 35 U.S.C. 154(b) by 0 days.

(21) Appl. No.: 18/323,294

(22) Filed: May 24, 2023

(65) Prior Publication Data

US 2023/0296310 A1 Sep. 21, 2023

Related U.S. Application Data

(63) Continuation of application No. PCT/US2021/065571, filed on Dec. 29, 2021.

(60) Provisional application No. 63/133,121, filed on Dec. 31, 2020.

(51) Int. Cl.
*F25D 29/00* (2006.01)
*F25D 19/00* (2006.01)

(52) U.S. Cl.
CPC ..... *F25D 29/001* (2013.01); *F25D 19/00* (2013.01)

(58) Field of Classification Search
CPC ..... F25B 2309/1411; F25B 2700/151; F25B 2309/00–2309/1428; F25B 19/00; F24F 11/38; F24F 11/49; F24F 11/32; G05B 23/0283; F25D 29/001; F25D 19/00
See application file for complete search history.

(56) References Cited

U.S. PATENT DOCUMENTS

| | | | | |
|---|---|---|---|---|
| 7,614,240 | B2 | 11/2009 | Rampersad | |
| 8,794,016 | B2 | 8/2014 | Ogden et al. | |
| 9,669,498 | B2 | 6/2017 | Pham | |
| 2008/0072608 | A1* | 3/2008 | Rampersad | F25B 9/145 62/228.1 |

OTHER PUBLICATIONS

Paul H. Barton et al., "Stirling cryocooler prognostics and health management (PHM)", Autotestcon, 2009 IEEE, IEEE, Piscataway, NJ, Sep. 14, 2009, pp. 78-81, ISBN: 978-1-4244-4980-4.

(Continued)

*Primary Examiner* — Cassey D Bauer
(74) *Attorney, Agent, or Firm* — Haynes and Boone, LLP

(57) ABSTRACT

Cryocooler health monitoring systems and methods are provided. In one example, a method includes determining, for each setpoint temperature of a plurality of setpoint temperatures, a respective power applied to a cryocooler to set a cold tip of the cryocooler to the setpoint temperature. The method further includes determining a first load line associated with the cold tip based on the plurality of setpoint temperatures and the respective powers applied to the cryocooler. The method further includes determining a health metric associated with the cold tip based on the first load line and a reference load line associated with the cryocooler. Related devices and systems are also provided.

20 Claims, 7 Drawing Sheets

(56) References Cited

OTHER PUBLICATIONS

R.G. Ross, Jr. et al., "AIRS Pulse Tube Coolers Performance Update—Twelve Years in Space", Jet Propulsion Laboratory California Institute of Technology, Pasadena, Cyrocoolers 18, International Cryocooler Conference, Inc., Boulder, CO, 2014, pp. 87-95.
E. Sandt et al., "Cryocooler Prognostic Health Management System", Sest, Inc., Middleburg Heights, OH, Airforce Research Laboratory, Kirtland Air Force Base, NM, Cryocoolers 16, International Cryocooler Conference, Inc., Boulder, CO, 2011, pp. 655-665.

* cited by examiner

CRYOCOOLER HEALTH MONITORING SYSTEMS AND METHODS

CROSS-REFERENCE TO RELATED APPLICATIONS

This application is a continuation of International Patent Application No. PCT/US2021/065571 filed Dec. 29, 2021 and entitled "CRYOCOOLER HEALTH MONITORING SYSTEMS AND METHODS," which claims priority to and the benefit of U.S. Provisional Patent Application No. 63/133,121 filed Dec. 31, 2020 and entitled "CRYOCOOLER HEALTH AND MONITORING SYSTEMS AND METHODS," all of which are incorporated herein by reference in their entirety.

TECHNICAL FIELD

One or more embodiments relate generally to cryogenic refrigeration devices and more particularly, for example, to cryocooler health monitoring systems and methods.

BACKGROUND

Cryogenic refrigeration systems are typically used to cool other devices to low temperatures between around 200 K and around 60 K, for example, depending on an overall heat load presented by a particular device. Cryogenic refrigeration systems may be, or may be referred to as, cryocoolers. Such cooled devices are often one of a variety of different types of sensor systems that operate better (e.g., produce measurements with less noise, higher sensitivity, higher accuracy, higher responsiveness, and/or with other generally more desirable performance metrics) when cooled and/or otherwise unable to operate without being cooled. For example, one such category of sensor systems that can benefit from being cooled includes infrared cameras (e.g., including a focal plane array (FPA) of individual infrared sensors), which measure or capture infrared (e.g., thermal) emissions from objects as infrared/thermal images and/or video. Cooling such infrared cameras generally increases detector sensitivity (e.g., by decreasing thermal noise intrinsic to the individual infrared sensors), which can result in overall more accurate and reliable infrared imagery.

In some cases, cryocoolers for use with infrared cameras can be quite small (e.g., designed to fit within a volume of approximately 3×3×2 inches, or less), yet be able to provide sufficient cooling power (e.g., a measure, typically in Watts, of a refrigerator's ability to extract heat from a coupled device) to cool at least portions of an infrared camera to the range of temperatures desired for, for example, relatively low noise thermal imagery, while experiencing the thermal load typical of an operating infrared camera. Reductions in system size and weight can be helpful to facilitate various compact system applications, including integration with a flight platform, an unmanned aerial vehicle (UAV), as a handheld weapon sight, and as a handheld camera, for example.

SUMMARY

In one or more embodiments, a method includes determining, for each setpoint temperature of a plurality of setpoint temperatures, a respective power applied to a cryocooler to set a cold tip of the cryocooler to the setpoint temperature. The method further includes determining a first load line associated with the cold tip based on the plurality of setpoint temperatures and the respective powers applied to the cryocooler. The method further includes determining a health metric associated with the cold tip based on the first load line and a reference load line associated with the cryocooler.

In one or more embodiments, a refrigeration system includes a cryocooler including a cold tip. The refrigeration system further includes a processing circuit configured to determine, for each setpoint temperature of a plurality of setpoint temperatures, a respective power applied to the cryocooler to set the cold tip to the setpoint temperature. The processing circuit is further configured to determine a first load line associated with the cold tip based on the plurality of setpoint temperatures and the respective powers applied to the cryocooler. The processing circuit is further configured to determine a health metric associated with the cold tip based on the first load line and a reference load line associated with the cryocooler.

The scope of the present disclosure is defined by the claims, which are incorporated into this section by reference. A more complete understanding of embodiments of the present disclosure will be afforded to those skilled in the art, as well as a realization of additional advantages thereof, by a consideration of the following detailed description of one or more embodiments. Reference will be made to the appended sheets of drawings that will first be described briefly.

Figure 1:
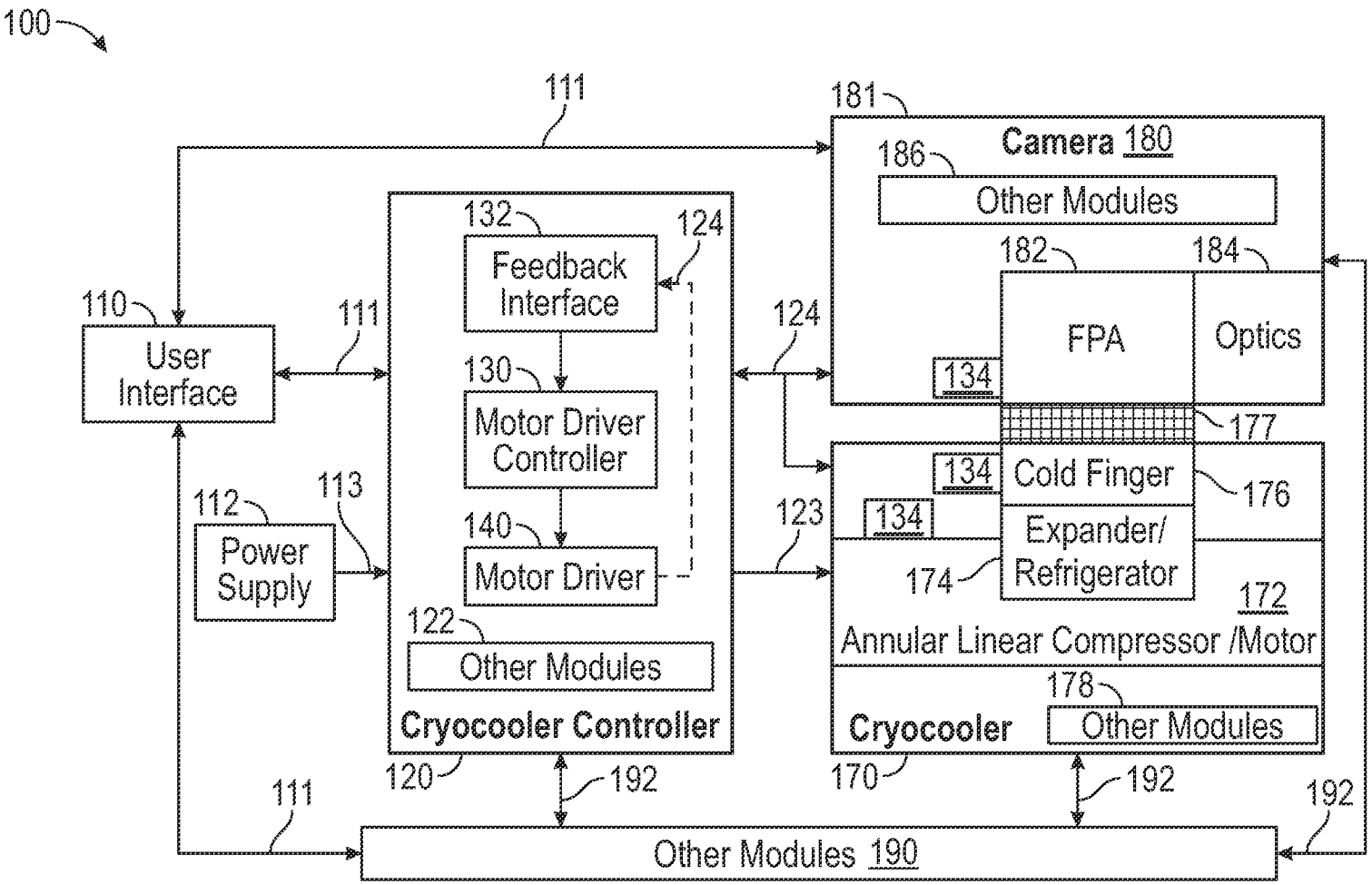
FIG. 1 illustrates a block diagram of a refrigeration system in accordance with one or more embodiments of the present disclosure.

Embodiments of the present disclosure and their advantages are best understood by referring to the detailed description that follows. It is noted that sizes of various components and distances between these components are not drawn to scale in the figures. It should be appreciated that like reference numerals are used to identify like elements illustrated in one or more of the figures.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced using one or more embodiments. In one or more instances, structures and components are shown in block diagram form in order to avoid obscuring the concepts of the subject technology. One or more embodiments of the subject disclosure are illustrated by and/or described in connection with one or more figures and are set forth in the claims.

Various systems and methods are provided for monitoring/assessing health of cryocoolers using variable cold tip temperatures. The cold tip of a cryocooler interfaces with and cools an electronic device, such as an FPA in a cooled camera. In some embodiments, a health assessment of a cryocooler may be based on load lines that relate applied powers (e.g., applied compressor input powers) to cold tip temperatures. The load lines may include reference load lines of the cryocooler and load lines of the cryocooler measured in the field (e.g., by a user). In an aspect, a reference load line may be a beginning of life load line generated/determined in the factory for the cryocooler. In some cases, the health assessment may further be based on measured life test data (e.g., determined in the factory for a given cryocooler design/model/implementation). The health assessment may be user-initiated and/or may be a built-in test provided by a refrigeration system that includes the cryocooler. In some cases, techniques utilized for health monitoring may also be used for performance screening of the cryocoolers.

Such a health assessment may be used at a beginning of life (e.g., in production, during manufacturing) to verify cooler performance and/or used later to determine a remaining useful life of the cryocooler. In this regard, the health of a given cryocooler may be characterized using a remaining cryocooler life. The remaining cryocooler life may be provided as an estimated amount of remaining cryocooler life (e.g., in hours), an estimated maximum power dissipation, an expected percent of life remaining bar (e.g., based on a nominal life of the cryocooler), and/or other health metrics. An indication of a result of the health assessment, such as an indication of the remaining cryocooler life, may be provided to the end users (e.g., audibly and/or visually). The end users may determine whether to perform an action (e.g., perform maintenance on a cryocooler, replace a cryocooler) based on the health assessment.

In one example, cryocoolers may be used to cool infrared sensors. Cooled infrared sensors (e.g., infrared sensors cooled using cryocoolers) may be deployed in applications in which predicting an end of life prior to failure is of particular interest to end users. For a cooled camera that includes cooled infrared sensors, the cryocooler lifetime generally determines a reliability and time before service of the camera. Capability to predict an end of life of the cryocooler prior to failure of the cryocooler may allow users to avoid mission failures, sensor downtime (e.g., due to cryocooler failure), and/or unplanned maintenance by scheduling sensor replacement and/or cryocooler replacement prior to failure.

In various embodiments, features/components to monitor the cryocooler health, such as setpoint temperature control and power measurements, are generally already included in a refrigeration system (e.g., a cryocooler controller and/or camera electronics) that includes the cryocooler. In this regard, such sensing capability is generally available to cryocoolers, such as power measurement features of cryocooler drive electronics, and are thus applicable, for example, to almost any tactical Stirling cryocooler. In some cases, baseline load line characteristics may be stored in persistent memory (e.g., flash memory) on-board of a cooled system (e.g., infrared camera core, cooler controller). The baseline load line characteristics may be stored at the beginning of the cooler lifetime in the factory. A user accessible feature, such as a user interface, may be provided to initiate an automated routine or built-in test (BIT) to recharacterize and store a load line of the cooler at any point when fielded. In an aspect, a programmable reference lookup table that correlates estimated remaining cooler hours and a difference between load lines in the field relative to baseline data may allow health metrics to be output to a user. By way of non-limiting examples, the health metric may be provided as an estimated amount of remaining cryocooler life (e.g., in hours), an estimated maximum power dissipation, an expected percent of life remaining bar (e.g., based on a nominal life of the cryocooler), and/or other health metrics.

Referring now to the drawings, FIG. 1 illustrates a block diagram of a refrigeration system 100 in accordance with one or more embodiments of the present disclosure. The refrigeration system 100 includes a power supply 112 providing an input power signal over power leads 113 to a cryocooler controller 120, which then provides motor drive signals and/or other system drive signals over power leads 123 to drive a compressor/motor 172 and/or other elements of a cryocooler 170. In general, the cryocooler 170 operates to cool a cold finger 176, which is thermally coupled to and configured to cool/extract heat from at least a portion (e.g., an FPA 182) of a camera 180. The cryocooler controller 120 may be configured to receive various sensor signals (e.g., corresponding to an input voltage of the input power signal provided by the power supply 112, an output voltage of motor drive signals generated by a motor driver 140/cryocooler controller 120, temperatures of various components of the refrigeration system 100 measured by temperature sensors 134, and/or other sensor signals corresponding to operation of the cryocooler 170, the compressor 172, and/or other elements of the refrigeration system 100) as feedback of operation of the cryocooler 170 and/or other elements of the refrigeration system 100, and to adjust drive signals provided to the compressor 172 and/or other elements of the cryocooler 170 accordingly (e.g., so as to provide a stable and/or desired temperature and/or cooling power with relatively little mechanical vibration at the cold finger 176). As one example, the cryocooler 170 may be implemented using a split design with separate compressor and expander modules. An example temperature range to operate cold tip temperatures may be approximately 70 K to 150 K.

It is noted that although the cryocooler 170 of the refrigeration system 100 of FIG. 1 cools the camera 180, the cryocooler 170 of FIG. 1 may be used to cool other electronic devices. In this regard, the camera 180 may instead be any device (e.g., sensor, imaging device, or other device type) that operates better (e.g., with higher signal to noise operational characteristics and/or with higher performance according to other performance metrics) when cooled, for example, or that is otherwise unable to operate without cooling.

A user interface 110 may be implemented as a personal computer, a tablet, a smart phone, a mobile computing device and/or vehicle interface, and/or one or more of a display, a touch screen, a keyboard, a mouse, a joystick, a knob, a button, a switch, and/or any other device capable of accepting user input and/or providing feedback to a user. More generally, the user interface 110 may be configured to provide user-level control of the refrigeration system 100 and to provide operational feedback to a user of the refrigeration system 100. In an embodiment, the operational feedback may include an indication of a health metric. In an aspect, a user may provide an input via the user interface 110 to initiate a test (e.g., built-in test) of the cryocooler 170 (e.g., to determine a health metric of the cryocooler 170) and/or other components of the refrigeration system 100.

The user interface 110 may be integrated with any appropriate logic device (e.g., processing device, microcontroller, processor, application specific integrated circuit (ASIC), field programmable gate array (FPGA), memory storage device, memory reader, or other device or combinations of devices) that may be adapted to execute, store, and/or receive appropriate instructions, such as software instructions implementing a control loop for controlling various operations of the refrigeration system 100. In addition, the user interface 110 may include a machine readable medium provided for storing non-transitory instructions for loading into and execution by the user interface 110. In these and other embodiments, the user interface 110 may be implemented with other components where appropriate, such as volatile memory, non-volatile memory, and/or various analog and/or digital components for interfacing with devices of the refrigeration system 100.

In various embodiments, the user interface 110 may be configured to provide an initialization signal to the cryocooler controller 120 to begin operation of the cryocooler 170, for example, or to provide a temperature setpoint and/or other operational parameters (e.g., corresponding to a desired operational state of the cryocooler 170) to the cryocooler controller 120. In specific embodiments, the user interface 110 may be configured to provide and/or update configuration data, including logic-level configuration data, to the cryocooler controller 120 to facilitate control of operation of the cryocooler 170. The user interface 110 may also be configured to receive an operating temperature, a power draw, an efficiency, and/or other operating characteristic and/or measured feedback of operation of the cryocooler 170 and/or other elements of the refrigeration system 100 (e.g., from the cryocooler controller 120 and/or other elements of the refrigeration system 100) and provide such information for display or indication to a user. In some embodiments, the user interface 110 may be configured to receive infrared images captured by the camera 180 (e.g., over data leads 111) and provide the infrared images for display to a user.

The power supply 112 may be implemented as a battery, a solar cell, a mechanical generator, and/or other power generator, and/or a delivery device, which may be provided specifically to power the refrigeration system 100, for example, and/or be coupled to, integrated with, or generated as part of the operation of a separate platform, such as a sensor, a vehicle, an aircraft, a watercraft, or other fixed or mobile platform. In some embodiments, the power supply 112 may be configured to provide an input direct current (DC) power signal over the power leads 113, such as a 12 V, 40 V, 48 V, or other voltage level DC power signal. More generally, the power supply 112 may be configured to provide any type of input power signal over the power leads 113 that can be converted by the cryocooler controller 120 into motor drive signals and/or other drive signals appropriate to drive the compressor 172 and/or other elements of the cryocooler 170.

The cryocooler controller 120 includes a motor driver controller 130, a feedback interface 132, a motor driver 140, and optional other modules 122. In additional embodiments, such as where the cryocooler 170 includes multiple motors and/or compressors, the cryocooler controller 120 may be implemented with multiple motor drivers, for example, that may each be controlled independently by motor driver control signals generated by the motor driver controller 130. In some cases, the cryocooler controller 120 may include a temperature control system to regulate a temperature (e.g., the cold tip temperature) of the cryocooler 170. In an aspect, the temperature control system may include and/or have access to memory that stores setpoint temperatures of the cryocooler 170.

The motor driver controller 130 may be implemented as any appropriate logic device (e.g., processing device, microcontroller, processor, ASIC, FPGA, memory storage device, memory reader, or other device or combination of devices) that may be adapted to execute, store, and/or receive appropriate instructions, such as software instructions implementing a control loop for controlling various operations of the cryocooler 170 and/or other components of the refrigeration system 100. For example, the motor driver controller 130 may be configured to receive operational parameters corresponding to operation of the cryocooler 170 and generate motor driver control signals configured to control operation of the motor driver 140 based, at least in part, on the received operational parameters.

In addition, the motor driver controller 130 may include a machine readable medium provided for storing data and/or non-transitory instructions for loading into and execution by the motor driver controller 130. In these and other embodiments, the motor driver controller 130 may be implemented with other components where appropriate, such as volatile memory, non-volatile memory, and/or various analog and/or digital components for interfacing with devices of the refrigeration system 100. In a particular embodiment, the motor driver controller 130 may be implemented substantially entirely by a programmable logic device (PLD), such as an FPGA, which may be configured to implement (e.g., using programmable resources) and perform any of the methods described herein. In such embodiments, the user interface 110 may be configured to provide/update configuration data over the data leads 111 to the motor driver controller 130 that is configured to implement/update/modify such methods in programmable resources and/or other elements of the motor driver controller 130.

The motor driver 140 may be implemented by one or more electrical components, such as various electrically controllable switches/transistors, an inductor, and a capacitor, that are configured to receive motor drive control signals and/or other drive signals from the motor driver controller 130 and to generate drive signals based, at least in part, on the motor driver control signals and/or the other drive signals, to drive the compressor 172 and/or other elements of the cryocooler 170.

The feedback interface 132 may be implemented by one or more of a multichannel analog to digital converter, a temperature sensor, a digital communication interface, and/or other electrical or electronic components configured to receive and/or measure sensor signals corresponding to operation of the cryocooler 170 and/or other elements of the refrigeration system 100 (e.g., over sensor leads 124) and convert such sensor signals into corresponding feedback data indicative of an operational state of the cryocooler 170 and/or other elements of the refrigeration system 100. The feedback interface 132 may be configured to provide such feedback data to the motor driver controller 130 to help adjust operation of the cryocooler 170 and/or other elements of the refrigeration system 100 according to various desired operational characteristics or states of the cryocooler 170 and/or other elements of the refrigeration system 100.

For example, the feedback interface 132 may be configured to receive one or more sensor signals (e.g., from the temperature sensor 134) and generate feedback data corresponding to operation of the cryocooler 170, and the motor driver controller 120 may be configured to receive the feedback data from the feedback interface 132 and generate motor driver control signals and/or other drive signals based, at least in part, on the feedback data. In some embodiments, one or more of the temperature sensors 134 may be implemented as diodes with characteristic voltage/temperature responses. The feedback interface 132 may be configured to provide a reference current to a diode and to measure/digitize the resulting voltage developed across the diode, which is proportional to the temperature of the temperature sensor 134. In some cases, such diodes may be integrated with the FPA 182 of the camera 180, for example, allowing direct and precise measurement and feedback of a temperature of the FPA 182.

In some embodiments, the one or more sensor signals received by the feedback interface 132 may include a measured temperature of the cold finger 176 of the cryocooler 170 and/or the camera 180 thermally coupled to the cryocooler 170 (e.g., via a thermal interface 177). Corresponding feedback data may be provided to the motor driver controller 120, which may be configured to determine a feedback error based, at least in part, on a set point corresponding to a desired temperature for the cold finger 176 and/or the camera 180 and the received feedback data. In such embodiments, the motor driver controller 120 may be configured to generate motor driver control signals based, at least in part, on the determined feedback error.

In other embodiments, the one or more sensor signals received by the feedback interface 132 may include a measured vibration amplitude of the cold finger 176 of the cryocooler 170 and/or the camera 180 thermally coupled to the cryocooler 170 (e.g., via the thermal interface 177). Corresponding feedback data may be provided to the motor driver controller 120, which may be configured to determine a constant or time varying amplitude, phase, and/or other drive signal characteristic based, at least in part, on a desired maximum vibration amplitude for the cold finger 176 and/or the camera 180 and the received feedback data. In such embodiments, the motor driver controller 120 may be configured to generate driver control signals based, at least in part, on the determined feedback error. Optional other modules 122 may include various power, digital, and/or analog signal interfaces, sensors, and/or additional circuitry configured to facilitate operation of any element of the cryocooler controller 120.

The cryocooler 170 may be implemented as any cooler or refrigeration system configured to convert electrical power delivered over the power leads 123 to the compressor 172 into cooling power generated by an expander/refrigerator 174 at the cold finger 176. In some embodiments, the cryocooler 170 may be implemented as a Stirling refrigerator. As shown in FIG. 1, the cryocooler 170 may include one or more temperature sensors 134 configured to provide sensor signals indicative of a measured temperature of a corresponding element of the cryocooler 170 (e.g., of the compressor 172, for fault detection, or of the cold finger 176, for operating temperature feedback) to the feedback interface 132 of the cryocooler controller 120. Optional other modules 178 may include additional temperature or electrical signal sensors, vibration sensors, various mechanical or thermal linkages, dewar cavities, working gas reservoirs, and/or other mechanical or electrical components or sensors configured to facilitate operation of any element of the cryocooler 170 and/or provide additional operational feedback to the cryocooler controller 120.

The cryocooler 170 may be thermally coupled to the camera 180 via the thermal interface 177. For example, the thermal interface 177 may be implemented by thermal grease, thermal tape, copper or aluminum plate or film, and/or other materials and/or structures configured to provide a reliable and highly thermally conductive link between the cryocooler 170 and at least a portion of the camera 180.

For example, the camera 180 may include an infrared imaging sensor implemented as an FPA 182, which may be coupled to optics 184 and be configured to image infrared radiation (e.g., including thermal radiation) emitted from a scene in view of the optics 184. In some embodiments, the cryocooler 170 may be directly coupled (e.g., via the thermal interface 177) to a sensor (e.g., the FPA 182) of the camera 180 and primarily be configured to cool such a sensor. In other embodiments, the cryocooler 170 may be coupled to various elements of the camera 180 (e.g., the optics 184, camera body 181, and/or other modules 186) and be configured to cool such various elements to help increase performance of the camera 180.

The camera 180 may include one or more temperature sensors 134 configured to provide sensor signals indicative of a measured temperature of a corresponding element of the camera 180 (e.g., of the FPA 182, for operating temperature feedback) to the feedback interface 132 of the cryocooler controller 120. Optional other modules 186 may include additional temperature or electrical signal sensors, FPAs of sensors sensitive to different spectra (e.g., visible light), other optical elements, and/or other mechanical or electrical components or sensors configured to facilitate operation of any element of the camera 180 and/or provide additional operational feedback to the cryocooler controller 120.

Also shown in FIG. 1 is optional other modules 190 of the refrigeration system 100 coupled to the user interface 120 over the data leads 111 and to other elements of the refrigeration system 100 over leads 192. Other modules 190 may include additional sensors, additional temperature or electrical signal sensors, an actuated gimbal and associated control subsystem to aim the camera 180 according to a desired direction, an accelerometer, a gyroscope, a global navigation satellite system receiver, a compass, other orientation and/or position sensors, vibration sensors, thermal management subsystems, structural support, thermal and/or electrical shielding, and/or other mechanical or electrical components or sensors configured to facilitate operation of any element of the refrigeration system 100 and/or provide additional operational feedback to the cryocooler controller 120.

Figure 2A:
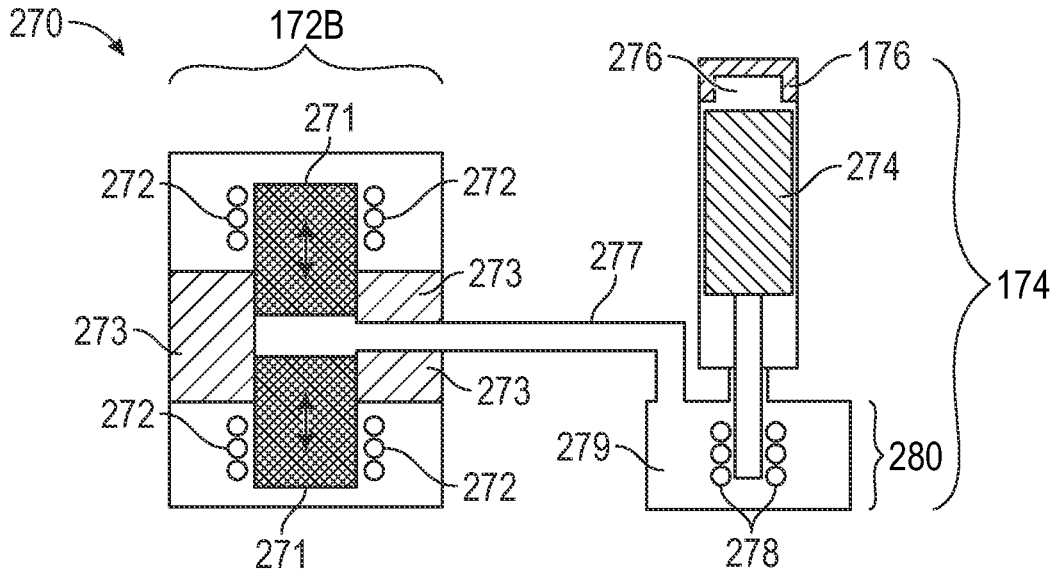
FIG. 2A illustrates a block diagram of a split-pair Stirling refrigerator/cryocooler including a non-integrated cylindrical linear compressor/motor in accordance with one or more embodiments of the present disclosure.
Figure 2B:
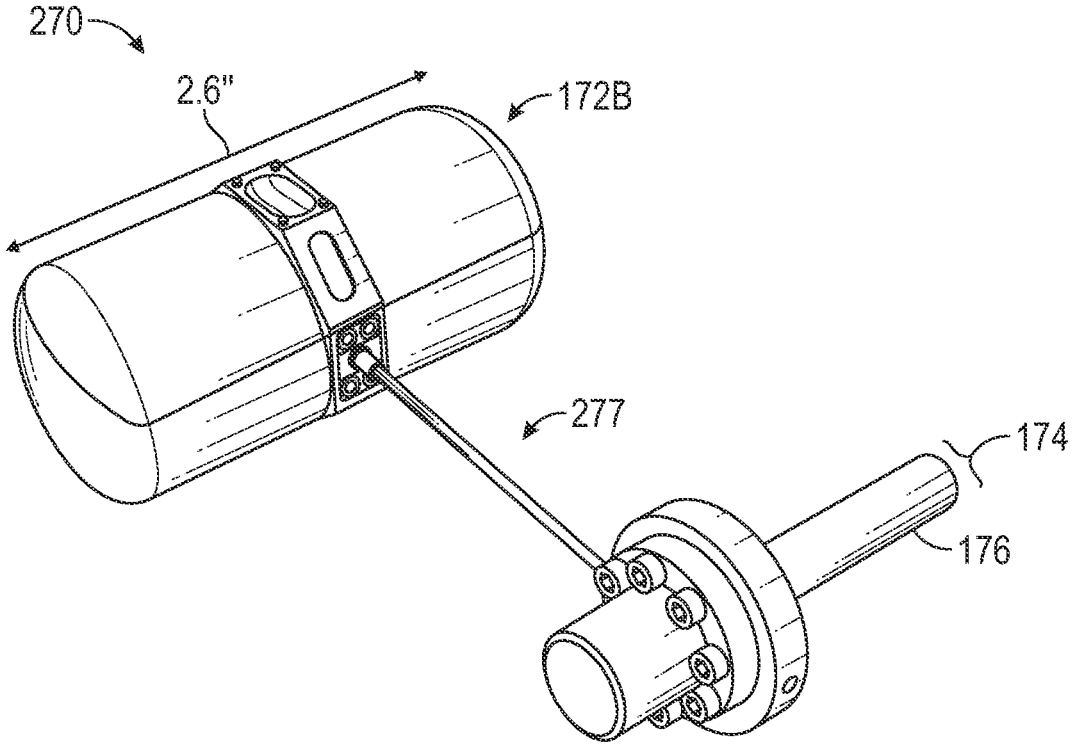
FIG. 2B illustrates a perspective view of the split-pair Stirling refrigerator/cryocooler of FIG. 2A.

FIG. 2A illustrates a block diagram of a split-pair Stirling refrigerator/cryocooler 270 including a non-integrated cylindrical linear compressor/motor 172B in accordance with one or more embodiments of the present disclosure. FIG. 2B illustrates a perspective view of the split-pair Stirling refrigerator/cryocooler 270. In the embodiment shown in FIG. 2A, the cryocooler 270 includes the non-integrated cylindrical linear compressor/motor 172B adjacent to and in fluid communication with a refrigerator/expander 174 via a gas transfer line/tube 277. In general operation, the compressor/motor 172B may be energized by the motor driver 140 to compress working gas within a compression space (e.g., between pistons 271) and deliver a compression wave/mass flow of working gas through the gas transfer line 277 to the expander/refrigerator 174. Heat in the working gas generated at least in part by the compression is extracted at the motor/compressor 172B and dissipated into the environment, rather than injected into the expander 174.

The compression wave/mass flow causes a regenerator/displacer 274 to move towards the cold finger 176 and through inductive windings 278 within an expander cylinder head 279, and at least a portion of the working gas travels through the regenerator/displacer 274 (e.g., a porous regenerator/displacer) and into an expansion space 276. A restoring force provided by a transducer/balancer system 280 and the inductive windings 278, and the drawback of the pistons 271 (e.g., as controlled by drive signals provided by the motor driver 140) in between compression strokes draws the regenerator/displacer 274 back towards the expander cylinder head 279 and expands the working gas within the expansion space 276, thereby extracting heat from the environment through the cold finger 176 and embedding it within the expanded working gas. Repeated operation of such cycle moves heat extracted from the cold finger 176 (e.g., and anything thermally coupled to the cold finger 176) to the motor/compressor 172B, and the transferred heat is dissipated into the environment (e.g., using various heat exchangers and thermal management coupled to the motor/compressor 172B), as is common with various Stirling cycle refrigeration systems.

As shown in FIG. 2A, the motor/compressor 172B may be implemented with inductive windings 272 configured to cause the pistons 271 to move towards each other to compress gas within the compression space therebetween. In some embodiments, the motor driver 140 of the cryocooler controller 120 may be electrically coupled to the windings 272 of the motor/compressor 172B (e.g., over the power leads 123) and the motor drive signals generated by the motor driver 140 may be used to drive the pistons 271 to generate the compression wave/mass flow, as in a linear motor/compression arrangement. Other motor/compressor arrangements are contemplated, including various linear motor arrangements, other compressor arrangements, and/or cyclical motor and/or motor/compressor arrangements.

As also shown in FIG. 2A, the expander 174 may be implemented with the inductive windings 278 configured to limit the stroke of the displacer 274 (e.g., so as not to impact the cold finger 176 or the expander cylinder head 279) and to help balance motion of the displacer 274 and/or compensate for the mechanical vibrations caused by reciprocation of the displacer 274 within the expander 174. In some embodiments, the motor driver 140 of the cryocooler controller 120 (e.g., or an additional motor driver of the cryocooler controller 120) may be electrically coupled to windings/coil 278 of the expander 174 (e.g., over the power leads 123) and balancer system drive signals generated by the motor driver 140 may be used to drive the displacer 274 and/or motion of the windings/coil 278 as in a linear motor arrangement, similar in some aspects to operation of the motor/compressor 172B described herein. In alternative embodiments, the transducer/balancer system 280 and/or the inductive windings 278 may be replaced and/or supplemented with a mechanical spring or spring system coupled to the displacer 274 within the expander cylinder head 279 and configured to provide such restoring forces.

Figure 3:
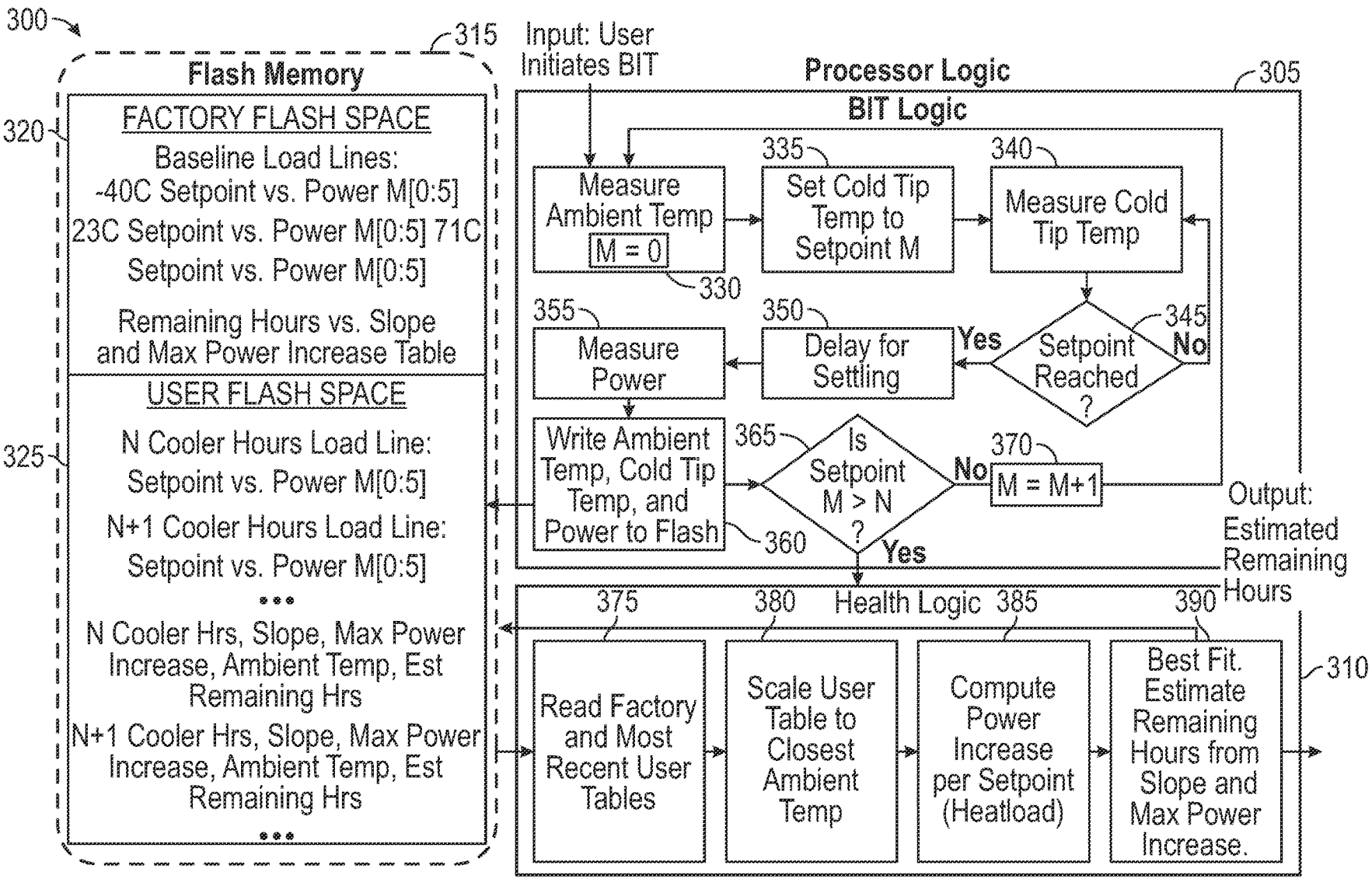
FIG. 3 illustrates an example system and associated flow for facilitating cryocooler health monitoring in accordance with one or more embodiments of the present disclosure.

FIG. 3 illustrates an example system 300 and associated flow for facilitating cryocooler health monitoring in accordance with one or more embodiments of the present disclosure. In an embodiment, the system 300 may facilitate health monitoring of the cryocooler 170 and 270 of FIGS. 1 and 2, respectively. The system 300 includes test logic 305, health assessment logic 310, and flash memory 315. In FIG. 3, various examples of inputs and outputs, data stored to power cycle persistent memory, and operations are provided. The test logic 305 and the health assessment logic 310 may be implemented by a processor(s), such as an FPGA, system-on chip, etc. In an embodiment, the test logic 305 and the health assessment logic 310 may be implemented by one or more processing circuits of the cryocooler controller 120 of FIG. 1. Communication between the test logic 305, the health assessment logic 310, and the flash memory 315 may be hardware-based and/or software-based. As an example of hardware-based communication, an input general purpose input/output (GPIO) may be used to initiate a BIT and an output GPIO may provide outputs indicative of a health metric of the cryocooler, such as varying output electrical signal levels (e.g., voltage levels) proportional to the remaining lifetime.

The flash memory 315 includes a factory flash space 320 to store baseline load lines (e.g., also referred to as reference load lines) and relationships (e.g., equations, correlation/lookup tables) to correspond parameters to a health metric (e.g., remaining cryocooler lifetime in hours). In FIG. 3, the factory flash space 320 stores baseline load lines associated with different ambient temperatures (e.g., also referred to as environmental temperature) and a correlation table(s) to map a slope and a power increase determined using the test logic 305 and the health assessment logic 310 to a remaining cryocooler lifetime. In one case, the relationships may be, may include, or may be based on, lifetime data collected using a Standard Advanced Dewar Assembly (SADA) test protocol to correlate measured parameters with a remaining lifetime of the cryocooler. The flash memory 315 also includes a user flash space 325 to store various data/parameters measured and/or determined by the test logic 305 and the health assessment logic 310, as further described herein.

A user may initiate the flow of FIG. 3 by providing an input to initiate the built-in test. Such a built-in test may be performed at the factory (e.g., to test the cryocooler) and/or in the field. A counter value M may be initiated to a 0 value. The flow associated with the test logic 305 may be performed for each of N setpoints. Each setpoint may be considered or referred to as a heat load of the cryocooler. At block 330, an ambient temperature is measured (e.g., by a temperature sensor of or otherwise coupled to the refrigeration system 100). At block 335, a cold tip is set to a temperature of an $M^{th}$ setpoint temperature (e.g., $0^{th}$ setpoint temperature for an initial iteration of the flow). The cold tip may be set to the temperature by controlling an operational parameter input, such as a power input, of the cryocooler. At block 340, the temperature of the cold tip is measured (e.g., by a temperature sensor of the refrigeration system 110). At block 345, the measured temperature of the cold tip is compared to the desired setpoint temperature to determine whether the desired setpoint temperature has been reached.

If the setpoint temperature is determined to not have been reached, the flow proceeds from block 345 back to block 340.

If the setpoint temperature is determined to have been reached, the flow proceeds from block 345 to block 350. At block 350, a delay before proceeding to block 355 is implemented to allow the cold tip temperature to settle and ensure that the cold tip temperature is stable (e.g., and to ensure that subsequent power measurements are also stable). Different coolers may be associated with different amounts of delay. As non-limiting examples, a cooler may be allowed to settle for around 2 minutes, 3 minutes, 4 minutes, 5 minutes, 7 minutes, 10 minutes, any duration of time between these time durations, or other time durations dependent on the cooler. If during settling the cold tip temperature changes from the desired setpoint temperature, the flow may proceed back to block 335 to cause appropriate control of the operational input to be performed to adjust the cold tip temperature to the desired setpoint temperature.

After the cold tip settles at the setpoint temperature, a power is measured at block 355. In some cases, the power may be a compressor input power applied to the cryocooler to set and maintain the cold tip temperature at the setpoint temperature. In some cases, the power measurements may be based on a voltage output to the cryocooler and/or a current output to the cryocooler. At block 360, the ambient temperature (e.g., measured at block 330), the cold tip temperature (e.g., measured at block 340), and the power (e.g., measured at block 355) is stored in the user flash space 325 of the flash memory 315. At block 365, a determination is made as to whether the counter value M is greater than a value N (e.g., to determine whether the ambient temperature, cold tip temperature, and power has been measured for each of the N setpoint temperatures). If the counter value M is not greater than the value N, the counter value M is incremented at block 370 and the flow proceeds back to block 330 (e.g., to obtain a power measurement for a next setpoint temperature). If the counter value M is greater than the value N, the flow proceeds to block 375 implemented by the health assessment logic 310.

At block 375, factory baseline load lines are read from the factory flash space 320 and the ambient temperature (e.g., measured at block 330), the cold tip temperature (e.g., measured at block 340), and the power (e.g., measured at block 355) are read from the user flash space 325. In some cases, the ambient temperature measured at block 330 when setting each temperature setpoint may be averaged. At block 380, the cold tip temperature (e.g., measured at block 340) and the power (e.g., measured at block 355) are scaled to an ambient temperature associated with the factory baseline load lines to provide a cryocooler-test load line (e.g., also referred to as a BIT load line). For example, in FIG. 3, the factory baseline load lines may include baseline load lines associated with an ambient temperature of −40° C., 23° C., and 71° C. In this example, if the measured ambient temperature (e.g., average ambient temperature of ambient temperatures measured at block 330) is around 25° C., the cold tip temperature and the power may be scaled to a corresponding cold tip temperature and power for an ambient temperature for 23° C., since 23° C. is the closest ambient temperature for which a factory baseline load line is available. At block 385, a power increase for each setpoint temperature is determined. The power increase may be determined by computing a difference between the factory baseline load line and the cryocooler-test load line for each setpoint temperature. At block 390, a slope and a maximum power increase are determined based on the factory baseline load line and the cryocooler load line, and a remaining lifetime (e.g., in hours) of the cryocooler is determined based on the slope and the maximum power increase. The estimated remaining lifetime of the cryocooler is provided as an output of the health assessment logic 310. In some cases, an indication of the estimated remaining lifetime may be provided to the end users (e.g., audibly and/or visually). The end users may determine whether to perform an action (e.g., perform maintenance on a cryocooler, replace a cryocooler) based on the health assessment.

Figure 4:
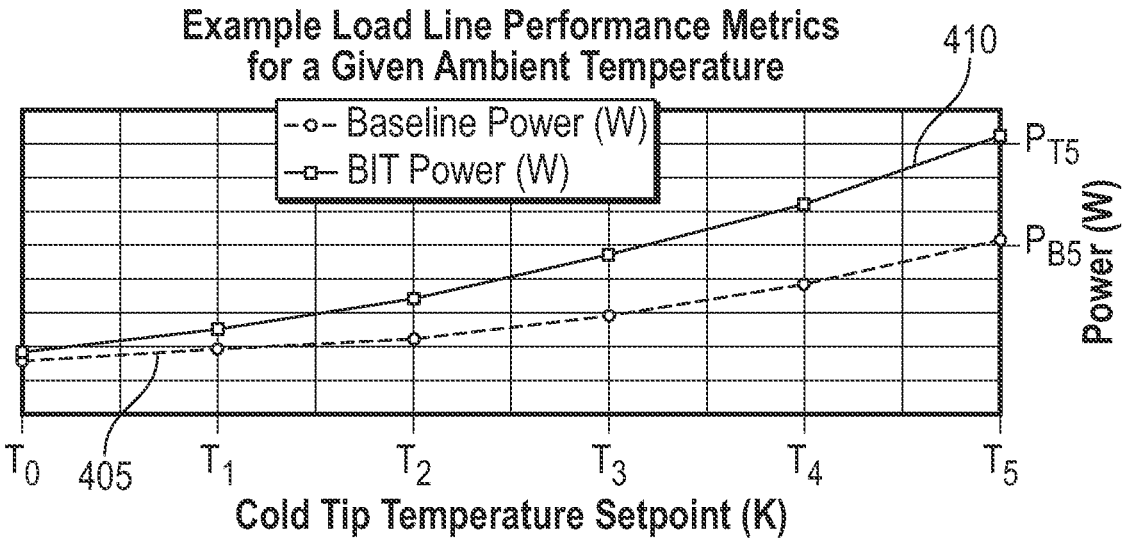
FIG. 4 illustrates a graph showing a load line performance metric at different cold tip setpoint temperatures for a given ambient temperature in accordance with one or more embodiments of the present disclosure.

As an example, FIG. 4 illustrates a graph showing a load line performance metric at different cold tip setpoint temperatures for a given ambient temperature in accordance with one or more embodiments of the present disclosure. In the graph, the load line performance metric is an input compressor power. The graph includes a baseline load line 405 for the ambient temperature and a cryocooler-test load line 410 measured in the field (e.g., via a user-initiated built-in-test). It is noted that different implementations of cryocoolers and/or different applications of the cryocoolers are associated with different load lines and/or different temperature setpoints. In some cases, the baseline load line 405 may be one of multiple baseline load lines stored in the factory flash space 320. Each of the baseline load lines may be associated with a respective ambient temperature. The baseline load line 405 may be selected based on its associated ambient temperature in relation to an ambient temperature during which the input power is measured. For example, the baseline load line 405 may be associated with an ambient temperature closest to the ambient temperature during which load line performance metrics are measured to obtain the cryocooler-test load line 410. The cryocooler-test load line 410 may include the input power measured at the various setpoint temperatures for an ambient temperature. As an example, the cryocooler-test load line 410 may be a result of a built-in test performed after around a runtime of 10,000 hours of the cryocooler. In some cases, the cryocooler load line 410 may be a measured load line that is scaled (e.g., at block 380) to the ambient temperature associated with the baseline load line 405. In FIG. 4, the cold tip temperature setpoints are $T_0$, $T_1$, $T_2$, $T_3$, $T_4$, and $T_5$. As one example, the temperature setpoints $T_0$ and $T_5$ may be 140 K and 60 K, respectively. As another example, the temperature setpoints $T_0$ and $T_5$ may be 160 K and 70 K, respectively. Other temperature setpoints may be used based on cryocooler design and/or application. An example range along the power axis may be 0 W to 10 W.

Figure 5:
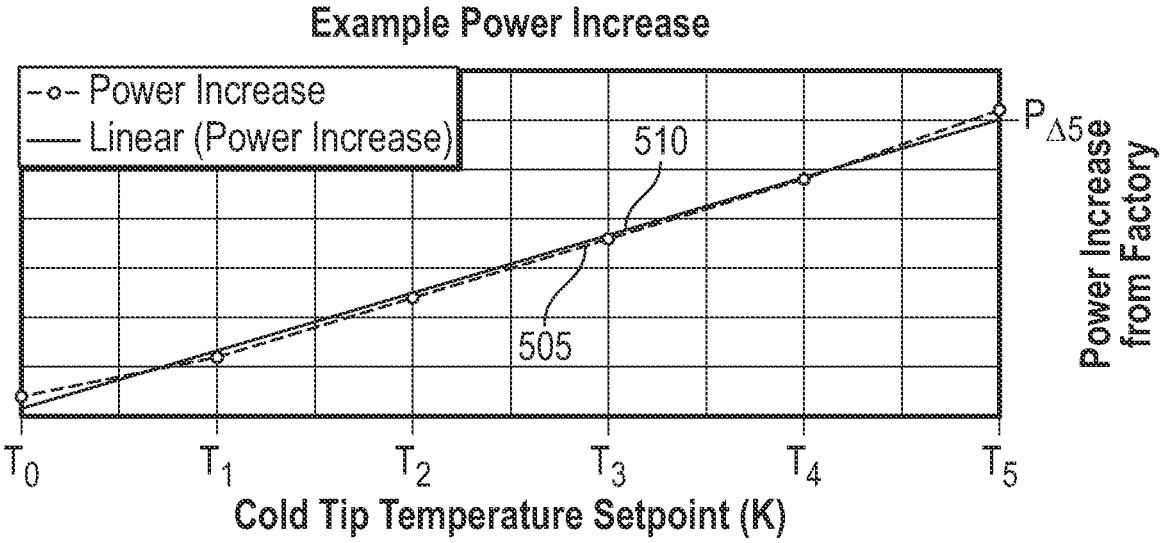
FIG. 5 illustrates a graph with a line showing a power increase from a baseline load line to a cryocooler-test load line in accordance with one or more embodiments of the present disclosure.

As shown by the baseline load line 405 and the cryocooler-test load line 410, for a certain cold tip temperature, a higher input power is needed as the cryocooler wears down to set the cold tip of the cryocooler to the cold tip temperature relative to the baseline. FIG. 5 illustrates a graph with a curve 505 showing a power increase from the baseline load line 405 to the cryocooler-test load line 410 in accordance with one or more embodiments of the present disclosure. In this regard, the curve 505 may be computed (e.g., at block 385) by subtracting the input power at each setpoint temperature for the baseline load line 405 from the input power at each corresponding setpoint temperature for the cryocooler-test load line 410. For example, at the setpoint temperature of $T_5$, the baseline load line 405 is at a power $P_{B5}$ and the cryocooler-test load line 410 is at a power $P_{T5}$, such that the difference leads to the difference line 505 being at a power change (e.g., a power difference/increase) $P_{\Delta 5}=P_{T5}-P_{B5}$ at the $T_5$ setpoint temperature. A best fit line 510 (e.g., an equation thereof) may be determined (e.g., at block 390) based on the curve 505. The best fit line 510 may be characterized at least by a slope and a maximum power increase (e.g., the power increase $P_{\Delta 5}$ at the $T_5$ setpoint temperature).

Based on the slope and the maximum power increase, an assessment of the cryocooler's remaining lifetime (e.g., in estimated hours remaining) may be determined (e.g., at block 390). The assessment may be provided to the user and/or used (e.g., by the user) to determine if the cryocooler should remain in service or should be taken out of service for preventative maintenance and/or replaced. For example, the assessment may be used to reduce or avoid any loss of mission capability. In an aspect, such an assessment may be performed as part of a scheduled maintenance and/or prior to scheduling a maintenance to track cryocooler health (e.g., using other tests and/or based on other performance metrics). In one case, to estimate the hours remaining, lifetime data collected with the SADA profile may be assessed to correlate the remaining hours with the maximum power increase (e.g., at the maximum heat load or equivalently at the lowest setpoint temperature) and the slope (e.g., ratio of power increase and temperature setpoint delta) for a given ambient temperature. In some cases, an associated correlation table and resulting remaining hours estimation may be stored on-board (e.g., in the flash memory 315) along with baseline load lines (e.g., collected in the factory) and any subsequent user-initiated load lines (e.g., BIT user-initiated load lines collected in the field).

It is noted that FIGS. 3 through 5 provides a non-limiting example system and flow. As another example, although FIGS. 3 through 5 illustrate an example with six setpoint temperatures, other systems and flows may use more than six setpoint temperatures, fewer than six setpoint temperatures, and/or different setpoint temperatures from those shown in FIGS. 3 through 5 may be used. It is further noted that adjacent setpoint temperatures need not be substantially equally spaced from each other as shown in FIG. 3. As an example, at block 330, alternatively or in addition to an ambient temperature, other ambient conditions (e.g., air flow, conduction) and/or operational conditions (e.g., warm up time) may be measured. As an example, at block 355, rather than measuring power directly, one or more other parameters may be measured and these other parameter(s) may correlate to/be indicative of a power. In the foregoing, an implicit load is associated with each setpoint. In some aspects, to oscillate the load, the FPA or other device being cooled by the cryocooler may be turned on and off.

In one or more embodiments, a cryocooler may be integrated with a thermal test dewar or an imaging dewar. The thermal test dewar may include a temperature measurement diode and a load resistor. The load resistor may provide a variable heat load on a cold tip of the cryocooler. Using the load resistor, the thermal test dewar may generate load lines of input power versus applied heat load. For example, the thermal test dewar may apply load to a resistor and create load lines at a constant cold tip temperature. As an example, these load lines may be used to characterize performance of the cryocooler by driving the cryocooler harder and looking at the input power. As another example, similar characterization may be achieved by lowering a setpoint (e.g., of the FPA coupled to the cryocooler) and looking at the input power needed to maintain each setpoint.

Figure 6:
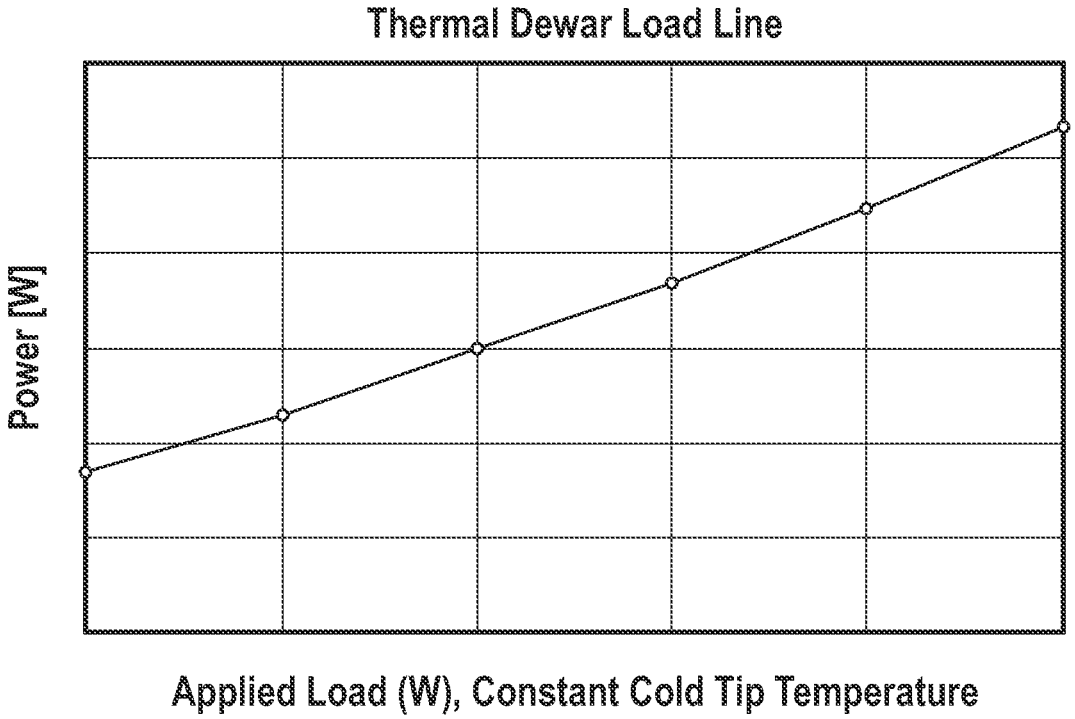
FIG. 6 illustrates a temperature-based load line associated with a thermal dewar in accordance with one or more embodiments of the present disclosure.

As an example, FIG. 6 illustrates a temperature-based load line associated with a thermal dewar in accordance with one or more embodiments of the present disclosure. The load line is generated at a certain operating temperature of the cryocooler (e.g., a cold tip temperature). As one example, the cold tip temperature may be a temperature within a range from 100 K to 140 K. Additional heater power may be applied in 100 mW increments from 0 mW to 500 mW while the input power (e.g., input compressor power) to the cryocooler is measured. The 0 mW case may be referred to as a "no load" case and may represent a parasitic conduction and radiation load of the dewar.

Figure 7:
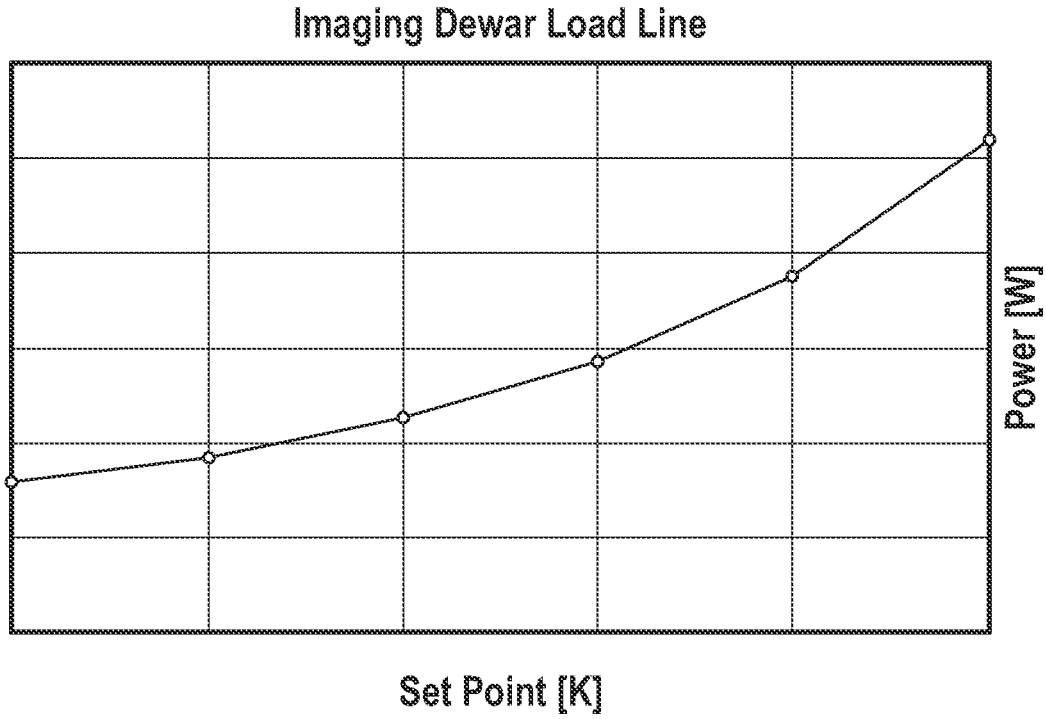
FIG. 7 illustrates a temperature-based load line associated with an imaging dewar in accordance with one or more embodiments of the present disclosure.

In various aspects, the imaging dewar does not have an adjustable load heater incorporated into it and thus does not generate a temperature-based load line in the same manner as the temperature-based load line (e.g., such as the load line in FIG. 6) for the thermal dewar. As an example, FIG. 7 illustrates a temperature-based load line associated with an imaging dewar in accordance with one or more embodiments of the present disclosure. For the imaging dewar, power may be measured while a cold tip temperature is varied. This has an effect of increasing parasitic loads on the cold tip as its temperature decreases, increasing the input power and generating a load line similar to that generated by the applied head loads of the thermal dewar.

In this regard, a load line of a cryocooler may be generated for the imaging dewar without needing to add an additional heat load and using various embodiments described herein, such as with respect to FIG. 3, with such a load line used as the basis for a health determination of the cryocooler. For initial production, load lines generated in this manner may be compared with a standard and a performance of the cooler may be verified. This may save time and cost in the production process by removing a test with a thermal dewar.

Figure 8:
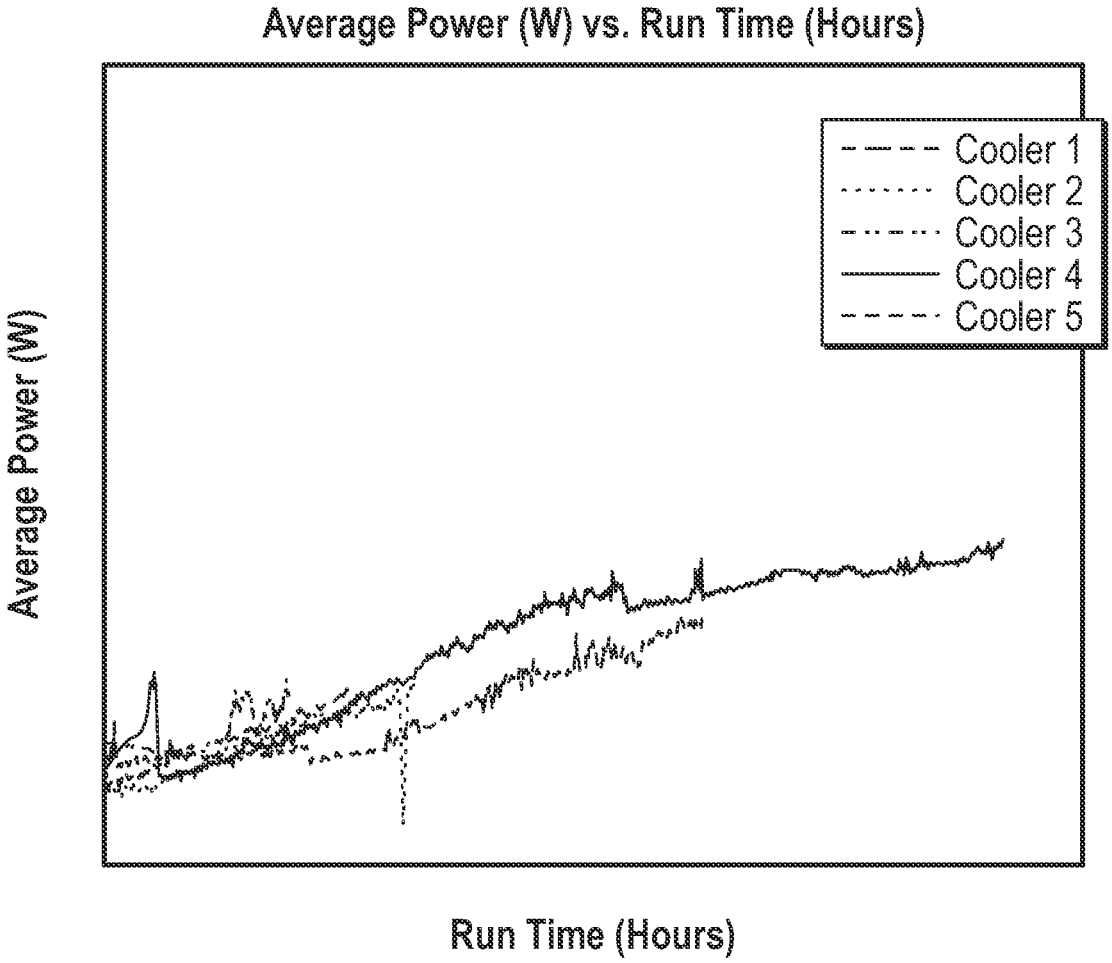
FIG. 8 illustrates a graph with life test results for various coolers.

In one or more embodiments, life test results may be used to facilitate cryocooler health monitoring. As an example, FIG. 8 illustrates a graph with life test results for various coolers. As an example, the life test results shown in the graph may be for the coolers at a nominal ambient temperature (e.g., 40° C., 50° C., or other temperature). The life test results may be based on the SADA test protocol. SADA testing is the industry standard for testing and reporting cryocooler lifetime (e.g., tactical cryocooler lifetime). The SADA testing may utilize a certain cycle duration, around a portion of the cycle duration being operational at each of three external temperatures (e.g., −30° C., 20° C., and 50° C.), and a cycle repeated until the coolers fail. As an example, a cryocooler may have a cold tip at 120 K with a 125 mW applied load. A cooler power may generally creep up slowly during a life test (and during the cryocooler lifetime). A failure may be indicated by an elevated power draw (e.g., an input power crossing a threshold), an inability of the cooler to maintain a temperature, and/or a long cooldown time (e.g., a cooldown time exceeding a threshold).

Figure 9A:
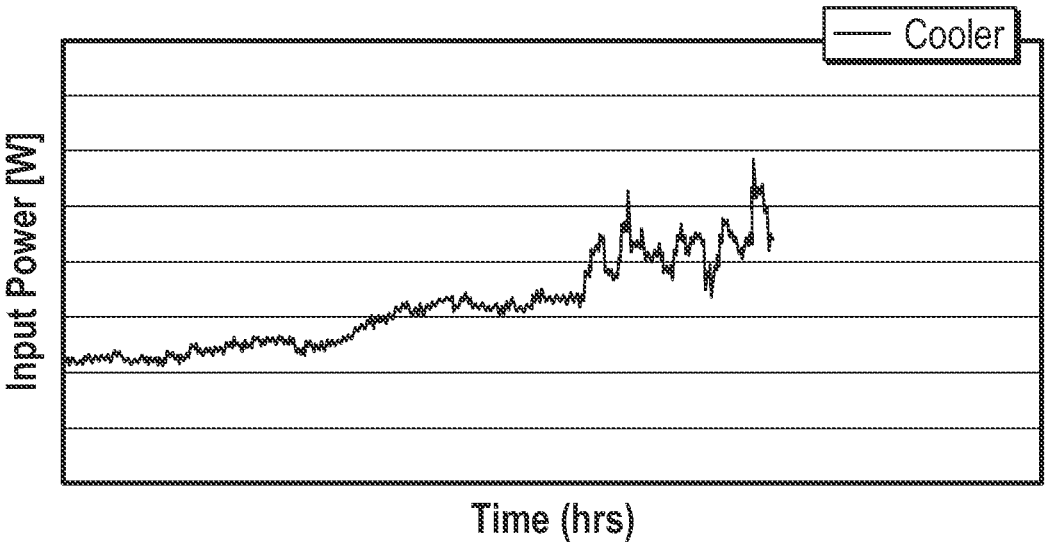
FIGS. 9A through 9C illustrate graphs with accelerated life test results for various coolers.
Figure 9B:
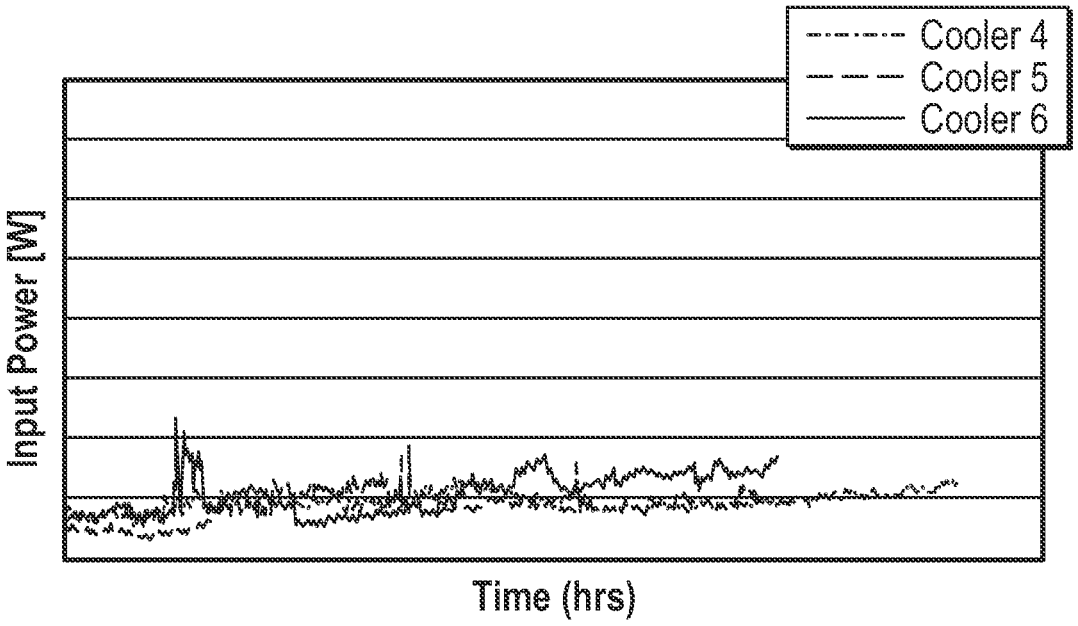
Figure 9C:
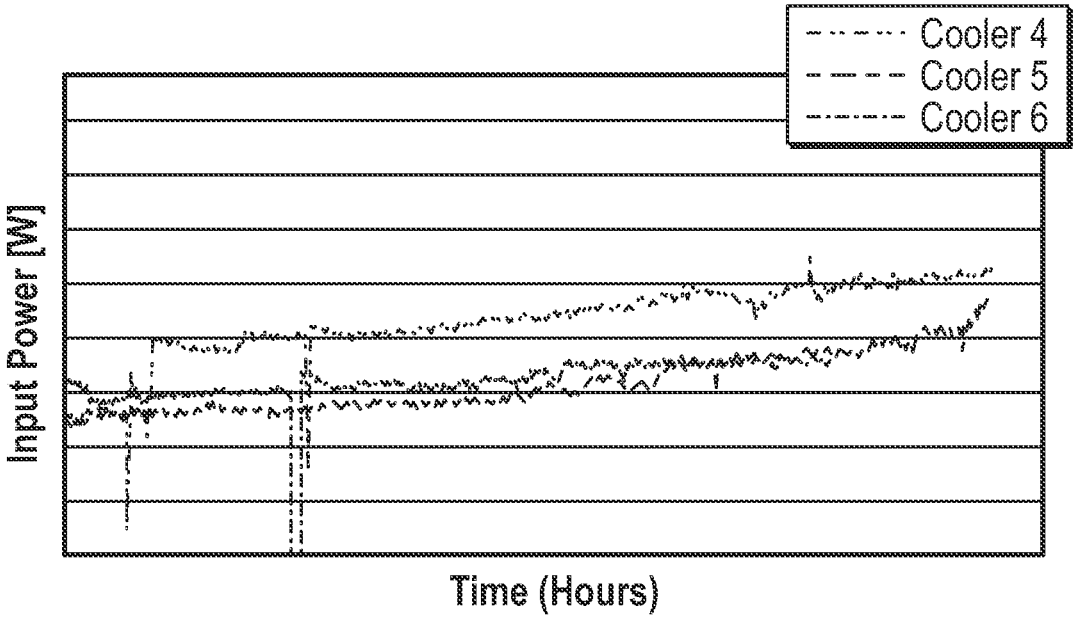

In some aspects, alternatively or in addition to the life test (e.g., shown in FIG. 8), an accelerated life test may be performed. In some cases, accelerated life testing may be performed to reduce a time for providing design changes. FIGS. 9A through 9C illustrate graphs with accelerated life test results for various coolers. In such tests, accelerating stresses may be applied to the coolers while they are run at a constant cold tip temperature (e.g., 100 K, 120 K, 140 K). The accelerating stresses in the test data shown are an applied heat load (e.g., an elevated cold tip heat load) and a heat rejection temperature. Results may be translated to SADA equivalent hours. Elevated power data may provide additional data points and better signal-to-noise ratio for determining cooler performance degradation. Although in FIGS. 9A through 9C the accelerated life test is performed on a linear Stirling cryocooler, the accelerated life test may generally be performed on any cryocooler.

In one or more embodiments, monitoring of cryocooler health and predicting remaining useful life may be based on a combination of a cold tip temperature-based load line with life test results (e.g., SADA life test results and/or accelerated life test results). By reducing the setpoint of the cooler and measuring the input power, a load line can be generated and compared with values from the cooler's beginning of life. The use of multiple points and the increased input power of the lower temperature points may help to improve an accuracy of determining a magnitude of performance degradation. Furthermore, coolers may exhibit performance degradation at high input power before the degradation is evident at their typical operating condition. This may be observed as an increase in cooldown time due to the cooler running at a maximum power during cooldown. A correlation of the measured load line degradation to the increase in power measured during the SADA and accelerated life tests can be used to estimate the cooler's remaining useful life.

Where applicable, various embodiments provided by the present disclosure can be implemented using hardware, software, or combinations of hardware and software. Also where applicable, the various hardware components and/or software components set forth herein can be combined into composite components comprising software, hardware, and/or both without departing from the spirit of the present disclosure. Where applicable, the various hardware components and/or software components set forth herein can be separated into sub-components comprising software, hardware, or both without departing from the spirit of the present disclosure. In addition, where applicable, it is contemplated that software components can be implemented as hardware components, and vice versa.

Software in accordance with the present disclosure, such as non-transitory instructions, program code, and/or data, can be stored on one or more non-transitory machine readable mediums. It is also contemplated that software identified herein can be implemented using one or more general purpose or specific purpose computers and/or computer systems, networked and/or otherwise. Where applicable, the ordering of various steps described herein can be changed, combined into composite steps, and/or separated into sub-steps to provide features described herein.

The foregoing description is not intended to limit the present disclosure to the precise forms or particular fields of use disclosed. Embodiments described above illustrate but do not limit the invention. It is contemplated that various alternate embodiments and/or modifications to the present invention, whether explicitly described or implied herein, are possible in light of the disclosure. Accordingly, the scope of the invention is defined only by the following claims.

What is claimed is:

1. A method for monitoring a health of a refrigeration system, the method comprising:

determining, for each setpoint temperature of a plurality of setpoint temperatures, a respective power applied to a cryocooler of the refrigeration system to set a cold tip of the cryocooler to the setpoint temperature, wherein the determining comprises, for each setpoint temperature:

applying a power to the cryocooler;

measuring a temperature of the cold tip in response to the applied power;

adjusting the applied power; and repeating the applying, the measuring, and the adjusting until the measured temperature of the cryocooler is the setpoint temperature to determine the power applied to the cryocooler to set the cold tip to the setpoint temperature;

determining, by a processing circuit of the refrigeration system, a first load line associated with the cold tip based on the plurality of setpoint temperatures and the respective powers applied to the cryocooler; and determining, by the processing circuit, a health metric associated with the cold tip based on the first load line and a reference load line associated with the cryocooler.

2. The method of claim 1, further comprising:

determining a condition associated with operation of the cryocooler; and selecting the reference load line from among a plurality of reference load lines based on the determined condition.

3. The method of claim 2, wherein the condition comprises an ambient temperature.

4. The method of claim 2, further comprising scaling the respective powers based on the determined condition to obtain scaled powers, wherein the first load line is based on the plurality of setpoint temperatures and the scaled powers.

5. The method of claim 1, further comprising determining a difference between the first load line and the reference load line, wherein the health metric is based on the difference.

6. The method of claim 5, further comprising determining, based on the difference, a slope and a maximum power increase, wherein the determining the health metric comprises mapping the slope and the maximum power increase to a value for the health metric.

7. The method of claim 5, wherein the health metric comprises a remaining lifetime of the cryocooler.

8. The method of claim 1, wherein the health metric is further based on life test results associated with the cryocooler.

9. The method of claim 1, further comprising displaying an indication of the health metric, wherein the powers comprise compressor motor input powers.

10. The method of claim 1, further comprising receiving user input to initiate a test of the cryocooler, wherein the determining the respective powers, the first load line, and the health metric are performed in response to the user input.

11. A refrigeration system comprising:

a cryocooler comprising a cold tip; and a processing circuit configured to:

determine, for each setpoint temperature of a plurality of setpoint temperatures, a respective power applied to the cryocooler to set the cold tip to the setpoint temperature;

determine a first load line associated with the cold tip based on the plurality of setpoint temperatures and the respective powers applied to the cryocooler; and determine a health metric associated with the cold tip based on the first load line and a reference load line associated with the cryocooler.

12. The refrigeration system of claim 11, wherein the processing circuit is further configured to:

determine a condition associated with operation of the cryocooler; and select the reference load line from among a plurality of reference load lines based on the determined condition.

13. The refrigeration system of claim 12, further comprising flash memory to store the plurality of reference load lines.

14. The refrigeration system of claim 12, further comprising a temperature sensor configured to measure an ambient temperature, wherein the condition comprises the ambient temperature.

15. The refrigeration system of claim 12, wherein the processing circuit is further configured to scale the respective powers based on the determined condition to obtain scaled powers, and wherein the first load line is based on the plurality of setpoint temperatures and the scaled powers.

16. The refrigeration system of claim 11, wherein the processing circuit is further configured to determine a difference between the first load line and the reference load line, and wherein the health metric is based on the difference.

17. The refrigeration system of claim 11, wherein the health metric comprises a remaining lifetime of the cryocooler, and wherein the powers comprise compressor motor input powers.

18. The refrigeration system of claim 11, wherein the health metric is further based on life test results associated with the cryocooler.

19. The refrigeration system of claim 11, wherein the processing circuit is further configured to receive user input to initiate a test of the cryocooler, wherein the processing circuit is configured to determine the respective powers, the first load line, and the health metric in response to the user input.

20. An infrared imaging device comprising the refrigeration system of claim 11 and infrared sensors configured to be cooled by the cryocooler.

* * * * *